US007368870B2

(12) United States Patent
Wang

(10) Patent No.: US 7,368,870 B2
(45) Date of Patent: May 6, 2008

(54) RADIATION EMITTING STRUCTURES INCLUDING PHOTONIC CRYSTALS

(75) Inventor: Shih-Yuan Wang, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 565 days.

(21) Appl. No.: 10/959,704

(22) Filed: Oct. 6, 2004

(65) Prior Publication Data

US 2006/0071585 A1 Apr. 6, 2006

(51) Int. Cl.
*H01K 1/00* (2006.01)

(52) U.S. Cl. ..... 313/580; 313/341

(58) Field of Classification Search ..... 313/115, 313/613, 578–580, 629–632, 271–279, 341–345, 313/315, 316

See application file for complete search history.

(56) References Cited

U.S. PATENT DOCUMENTS

| | | | | |
|---|---|---|---|---|
| 5,335,240 | A | 8/1994 | Ho et al. | |
| 5,440,421 | A | 8/1995 | Fan et al. | |
| 5,600,483 | A | 2/1997 | Fan et al. | |
| 5,684,817 | A | 11/1997 | Houdre et al. | |
| 5,739,945 | A | 4/1998 | Tayebati | |
| 5,771,253 | A | 6/1998 | Chang-Hasnain et al. | |
| 5,784,400 | A | 7/1998 | Joannopoulos et al. | |
| 5,802,236 | A | 9/1998 | DiGiovanni et al. | |
| 5,814,840 | A | 9/1998 | Woodall et al. | |
| 5,990,850 | A | 11/1999 | Brown et al. | |
| 5,997,795 | A | 12/1999 | Danforth et al. | |
| 5,998,298 | A | 12/1999 | Fleming et al. | |
| 6,058,127 | A | 5/2000 | Joannopoulos et al. | |
| 6,134,043 | A | 10/2000 | Johnson et al. | |
| 6,274,293 | B1 | 8/2001 | Gupta et al. | |
| 6,339,030 | B1 | 1/2002 | Constant et al. | |
| 6,522,820 | B2 | 2/2003 | Wang | |
| 6,555,948 | B1 | 4/2003 | Noll | |
| 6,583,350 | B1 | 6/2003 | Gee et al. | |
| 6,611,085 | B1 | 8/2003 | Gee et al. | |
| 6,711,200 | B1 | 3/2004 | Scherer et al. | |
| 6,768,256 | B1 * | 7/2004 | Fleming et al. | 313/501 |
| 2003/0071564 | A1 * | 4/2003 | Hirayama | 313/501 |
| 2004/0239228 | A1 * | 12/2004 | Perlo et al. | 313/341 |
| 2005/0168147 | A1 * | 8/2005 | Innocenti et al. | 313/633 |

FOREIGN PATENT DOCUMENTS

| | | |
|---|---|---|
| WO | WO/03/058676 A2 | 7/2003 |

OTHER PUBLICATIONS

Bergman, R., et al., *Filament Lamps, Technical Information Series*, GE Research & Development Center, Feb. 1998, pp. 1-30.

Blanco, Alvaro, et al., "Large-scale synthesis of a silicon photonic crystal with a complete three-dimensional bandgap near 1.5 micrometres," Nature, vol. 405, May 25, 2000, pp. 437-440.

(Continued)

*Primary Examiner*—Karabi Guharay
*Assistant Examiner*—Christopher M. Raabe

(57) ABSTRACT

Radiation emitting structures that include an active radiation emitter and a passive photonic crystal structure surrounding the emitter are disclosed. The passive photonic crystal structure is transparent to wavelengths of electromagnetic radiation within the visible region of the electromagnetic spectrum. Also disclosed are incandescent lamps that include such radiation emitting structures.

41 Claims, 8 Drawing Sheets

OTHER PUBLICATIONS

Campbell, M., et al., "Fabrication of photonic crystals for the visible spectrum by holographic lithography," Nature, vol. 404, Mar. 2, 2000, pp. 53-56.

Joannopoulos, J.D., et al., "Photonic crystals: putting a new twist on light," Nature, vol. 386, Mar. 13, 1997, pp. 143-149.

Johnson, Steven G., et al., *Introduction to Photonic Crystals: Block's Theorem, Band Diagrams, and Gaps* (*But No Defects*), Feb. 3, 2003, pp. 1-16.

Lin, S.Y., et al., "Three-dimensional photonic-crystal emitter for thermal photovoltaic power generation," App. Phys. Lett., vol. 83, No. 2, Jul. 14, 2003, pp. 380-382.

Lin, Shawn-Yu, et al., "Experimental observation of photonic-crystal emission near a photonic band edge," Appl. Phys. Lett., vol. 83, No. 4, Jul. 28, 2003, pp. 593-595.

Qi, Minghao, et al., "A three-dimensional optical photonic crystal with designed point defects," Nature, vol. 429, Jun. 3, 2004, pp. 538-542.

Vlasov, Yuril A., et al., "On-chip natural assembly of silicon photonic bandgap crystals," Nature, vol. 414, Nov. 15, 2001, pp. 289-293.

* cited by examiner

Spectral radiant emittance of a blackbody with temperature as a parameter

Exemplary graph of the approximate spectral radiant emittance of a radiation emittance structure according to the invention with temperature as a parameter Exemplary graph of the approximate spectral radiant emittance of a photonic crystal emitter with temperature as a parameter

RADIATION EMITTING STRUCTURES INCLUDING PHOTONIC CRYSTALS

FIELD OF THE INVENTION

The present invention relates to radiation emitting structures including photonic crystals for use in incandescent lamps. More particularly, the invention relates to radiation emitting structures including an active radiation emitter surrounded by a passive photonic crystal structure that is transparent to wavelengths of electromagnetic radiation within the visible region of the spectrum.

BACKGROUND OF THE INVENTION

In conventional incandescent lamps, a filament is provided between two electrical contacts, and current is passed between the contacts through the filament. The electrical resistance of the filament material generates heat in the filament. Typical filaments in incandescent lamps operate between about 2500 K and about 3000 K. The heated filament emits electromagnetic radiation over a range of wavelengths, some of which are within the visible region of the electromagnetic spectrum. The emittance of conventional filaments at a given temperature may be approximated by Planck's equation for black body radiation.

Conventional incandescent lamps, while providing high quality, inexpensive lighting, are extremely inefficient. Only about five to ten percent of the energy supplied to a filament is converted into electromagnetic radiation at wavelengths within the visible region of the spectrum (i.e., about 380 nm to about 780 nm). A large amount of energy is converted to radiation in the infrared region of the spectrum (i.e., between about 780 nm to about 3000 nm), and wasted as heat.

From the time incandescent lamps were first invented by Thomas Edison, significant research has been conducted to find new methods, materials, and structures to increase the amount of electromagnetic radiation emitted in the visible region of the spectrum and minimize the amount of radiation emitted outside the visible region, thereby improving the efficiency of the lamp.

Tungsten, since its first use as an incandescent filament in 1911, continues to be the material of choice as a result of its emissive properties. True black bodies do not exist in nature. However, the radiation properties of materials may be described by including factors or variables for the material's emissivity into Planck's equations for black body radiation. Emissivity is the ratio of the spectral radiant emittance (i.e., emitted power per unit area per unit wavelength) of a material to the theoretical spectral radiant emittance of a true black body. The emissivity for a given material is not constant and may vary with wavelength, the angle of observation, and the temperature of the material. The emissivity of tungsten varies with wavelength and is higher in the visible region of the electromagnetic spectrum than in the infrared region (i.e., it radiates more electromagnetic radiation in the visible region than a true black body), which makes it the material of choice for use in incandescent lamps.

Other inventions directed to increasing the efficiency of incandescent lamps include coiling the filament into coiled structures, and filling the bulb of the lamp with halogen gas. In addition, coatings of materials that are transparent to radiation in the visible region, but reflective to radiation in the infrared region, have been applied to the bulb of incandescent lamps to reflect infrared radiation emitted by the filament back onto the filament itself, thereby further heating the filament.

Recently, the use of photonic crystals as incandescent emitters has been investigated. Photonic crystals are structures comprising at least two materials having different dielectric constants interspersed periodically throughout the structure. Photonic crystals may not emit radiation continuously over a range of wavelengths when the crystal is heated, as does a classical black body. Photonic crystals may emit strongly at certain wavelengths, but only weakly, if at all over a range of wavelengths at which the crystal would be expected to emit if it were a classical black body.

Although the efficiency of incandescent lamps has been improved over time, there remains a significant quantity of energy that is emitted as electromagnetic radiation outside the visible region of the spectrum. This energy is wasted and contributes to the inefficiency of conventional incandescent lamps.

BRIEF SUMMARY OF THE INVENTION

The present invention, in a number of embodiments, includes radiation emitting structures that include an active radiation emitter and a passive photonic crystal structure surrounding the emitter. The passive photonic crystal structure is transparent to wavelengths of electromagnetic radiation within the visible region of the electromagnetic spectrum. The invention also includes incandescent lamps that include radiation emitting structures according to the invention disclosed herein.

The features, advantages, and alternative aspects of the present invention will be apparent to those skilled in the art from a consideration of the following detailed description taken in combination with the accompanying drawings.

BRIEF DESCRIPTION OF THE SEVERAL VIEWS OF THE DRAWINGS

While the specification concludes with claims particularly pointing out and distinctly claiming that which is regarded as the present invention, the advantages of this invention can be more readily ascertained from the following description of the invention when read in conjunction with the accompanying drawings in which:

DETAILED DESCRIPTION OF THE INVENTION

The present invention, in a number of embodiments, includes radiation emitting structures for use in incandescent lamps, and incandescent lamps including such structures. The radiation emitting structures disclosed herein include an active radiation emitter surrounded by a passive photonic crystal structure that is transparent to wavelengths of electromagnetic radiation within the visible region of the electromagnetic spectrum.

The exemplary embodiments of the invention disclosed herein decrease the amount of wasted energy emitted from an incandescent lamp as electromagnetic radiation outside the visible region of the spectrum.

Figure 2:
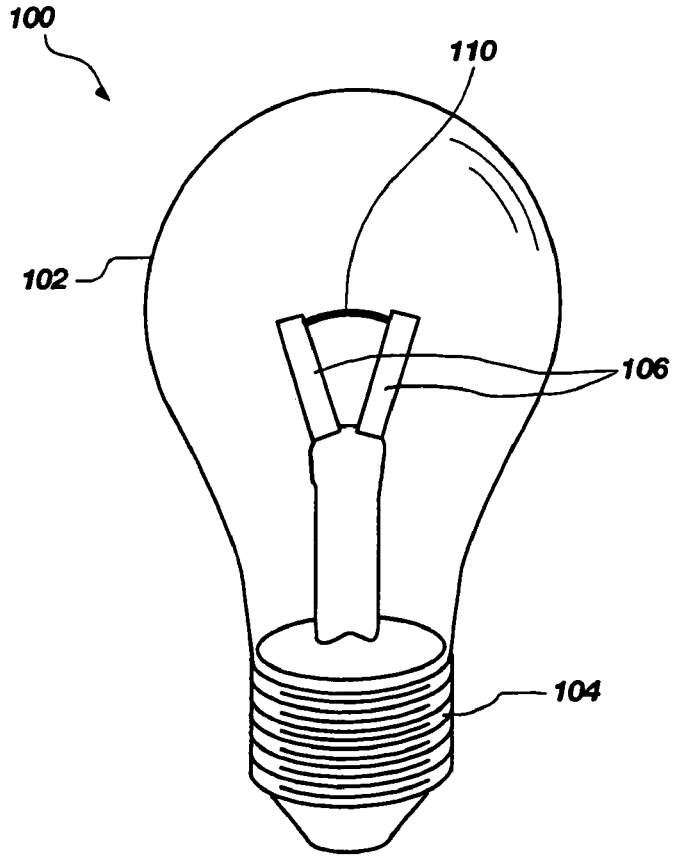
FIG. 2 is a perspective view of an incandescent lamp including an exemplary radiation emitting structure.

An exemplary incandescent lamp 100 is shown in FIG. 2 that includes a glass bulb 102, a conventional electrically conductive threaded base 104, electrical contacts 106 electrically communicating with the threaded base 104, and an exemplary radiation emitting structure 110 extending between the electrical contacts 106. It should be noted that the incandescent lamp 100 alternatively may be configured as any other known design for an incandescent lamp.

Figure 3A:
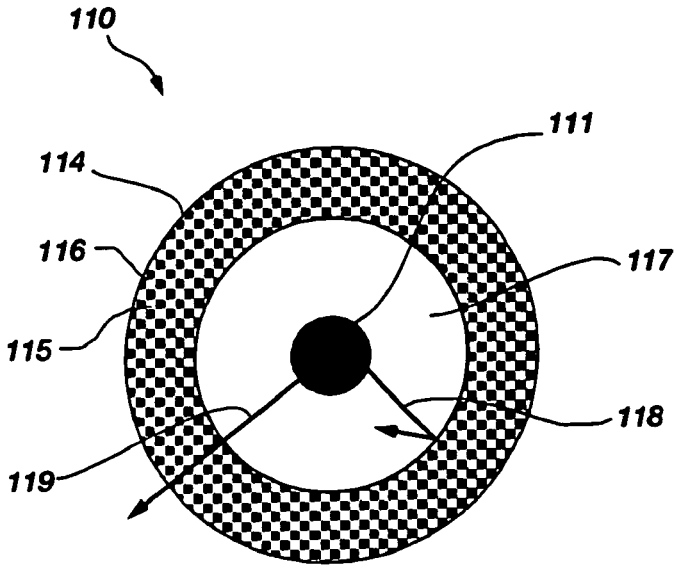
FIG. 3A is a cross-sectional view of an exemplary radiation emitting structure that may be used in the incandescent lamp of FIG. 2.

A cross-sectional schematic view of the exemplary radiation emitting structure 110 is shown in FIG. 3A. The radiation emitting structure 110 includes an active radiation emitter 111. The active radiation emitter 111 may include a conventional elongated filament formed from, for example, tungsten, tungsten alloy, carbon, or any other material that will emit radiation in the visible region of the spectrum when heated, and that will also exhibit structural integrity at the elevated operating temperature of the material.

The radiation emitting structure 110 also includes a passive photonic crystal structure 114, which functions as an infrared reflector, circumferentially surrounding the active radiation emitter 111.

Photonic crystals are formed by dispersing a material having a first dielectric constant periodically within a matrix having a second, different dielectric constant such that dielectric periodicity is exhibited in a direction through the structure. A one-dimensional photonic crystal is a three-dimensional structure that exhibits dielectric periodicity in only one dimension. Bragg mirrors (distributed Bragg reflectors) are a known example of a one-dimensional photonic crystal. The alternating thin layers of a Bragg mirror have different dielectric constants. The combination of several thin layers forms a three-dimensional structure that exhibits dielectric periodicity in the direction orthogonal to the planes of the thin layers. No periodicity is exhibited in directions parallel to the planes of the layers.

A two-dimensional photonic crystal can be formed by periodically dispersing rods, columns, or fibers of a first material having a first dielectric constant within a matrix having a second, different dielectric constant. Two-dimensional photonic crystals may exhibit dielectric periodicity in the directions perpendicular to the longitudinal axis of the rods, columns, or fibers, but not in directions parallel to the longitudinal axis.

Finally, a three-dimensional photonic crystal can be formed by periodically dispersing small spheres or other spatially confined areas of a first material having a first dielectric constant within a matrix of a second material having a second, different dielectric constant. Three-dimensional photonic crystals may exhibit dielectric periodicity in all directions within the crystal.

Photonic crystal structures may exhibit a photonic bandgap—a range of wavelengths for which radiation is forbidden to exist within the interior of the structure—due to Bragg scattering of incident radiation off the periodic dielectric interfaces. In other words, there is a range of wavelengths of radiation that may be reflected by the crystal when the radiation is incident thereon in a direction in which the crystal exhibits dielectric periodicity.

The finite-difference time-domain method may be used to solve the full-vector time-dependent Maxwell's equations on a computational grid including the crystal's feature dimensions and corresponding dielectric constant within the features to determine what wavelengths may be forbidden to exist within the interior of any given crystal.

The passive photonic crystal structure 114 of the radiation emitting structure 110 may include a two-dimensional photonic crystal structure, formed by providing elongated passive fibers 115 extending through a matrix 116 parallel to the longitudinal axis of the active radiation emitter 111. The passive fibers 115 may be formed from, for example, dielectric materials such as carbon, silicon carbide, silica, alumina, titania, or any other dielectric material that may be formed into elongated filaments. Alternatively, the passive fibers 115 may be formed from, for example, a metal such as silver, gold, tungsten, copper, any other metal or metal alloy. Photonic crystal structures comprising metal materials may exhibit a broader bandgap than those formed from dielectric materials. However, metallic crystal structures may result in increased attenuation of visible radiation relative to crystal structures formed from dielectric materials. The passive fibers 115 may have a diameter between about 0.05 microns and about 8 microns. The matrix 116 may include, for example, air, silica, silicon carbide, silicon nitride, alumina, or any other material having a dielectric constant different from the dielectric constant of the material of the passive fibers 115, and exhibiting structural integrity at the required operating temperatures. Passive fibers 115 are dispersed periodically throughout the matrix 116 and may be separated from one another by an average distance between about 0.05 and about 8 microns.

Figure 3B:
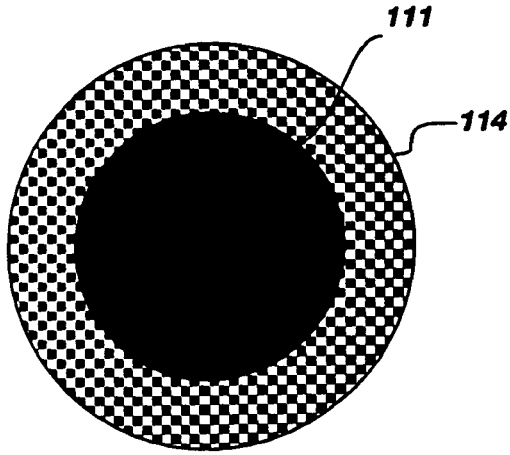
FIG. 3B is a cross-sectional view of the exemplary radiation emitting structure of FIG. 3A without an intermediate layer of material.

An intermediate layer of material 117 may be disposed between the active radiation emitter 111 and the passive photonic crystal structure 114, as shown in FIG. 3A. The intermediate layer of material 117 should be electrically insulating and transparent to wavelengths of electromagnetic radiation within the visible region of the spectrum. The intermediate layer of material 117 may be formed from, for example, silica or any other suitable material. Alternatively, the intermediate layer of material 117 may be omitted and the passive photonic crystal structure 114 provided directly adjacent the outer surface of the active radiation emitter 111, as shown in FIG. 3B.

Referring to FIG. 3A, the passive photonic crystal structure 114 may exhibit dielectric periodicity in the directions parallel to the plane of the transverse cross-section illustrated in the figure. The passive photonic crystal structure 114 may be transparent to wavelengths of electromagnetic radiation within the visible region of the spectrum. However, the passive photonic crystal structure 114 may exhibit a photonic bandgap over a range of wavelengths outside the visible region, such as in the infrared region. For example, the passive photonic crystal structure 114 may exhibit a photonic bandgap between about 700 nm and about 10000 nm.

Figure 1:
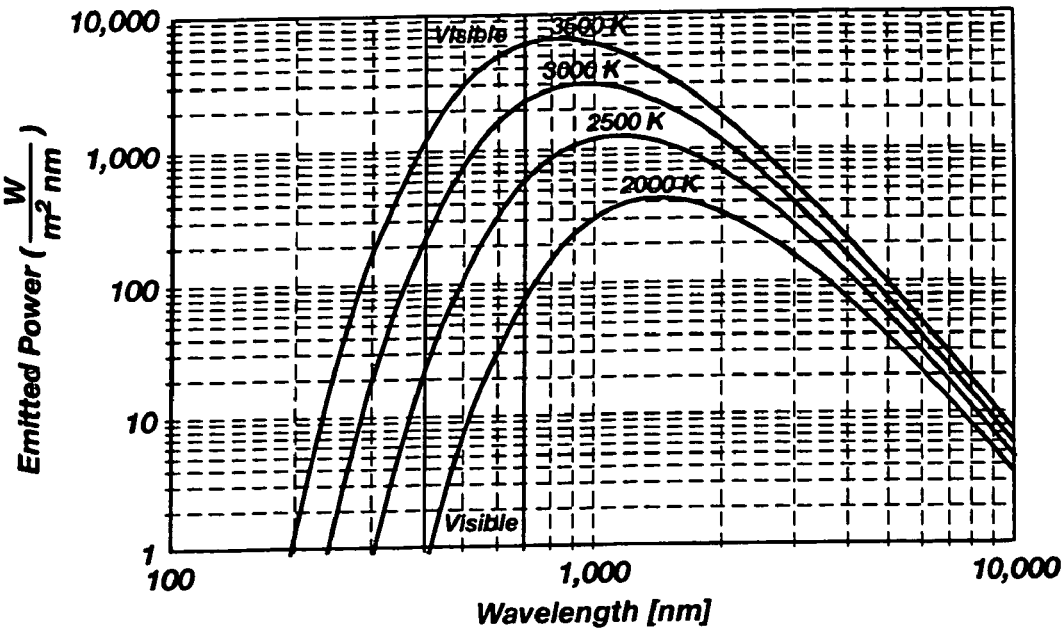
FIG. 1 is a graph of the spectral radiant emittance of a black body as a function of wavelength at various temperatures.

The active radiation emitter 111 may be heated by connecting the incandescent lamp 100 to a power supply and passing electrical current through the active radiation emitter 111. The electrical resistance of the active radiation emitter 111 will generate heat. As the active radiation emitter 111 gets hot (e.g., approximately greater than 1500 K), it will emit radiation over a range of wavelengths including those in the visible region of the spectrum. The majority of the radiation, however, is emitted at wavelengths outside the visible region of the spectrum, typically in the infrared region. For example, when the active radiation emitter 111 is at a temperature of 2500 K, it may emit radiation approximately as shown by the line in FIG. 1 corresponding to 2500K, which illustrates the theoretical emitted power of a black body over a range of wavelengths.

Figure 9:
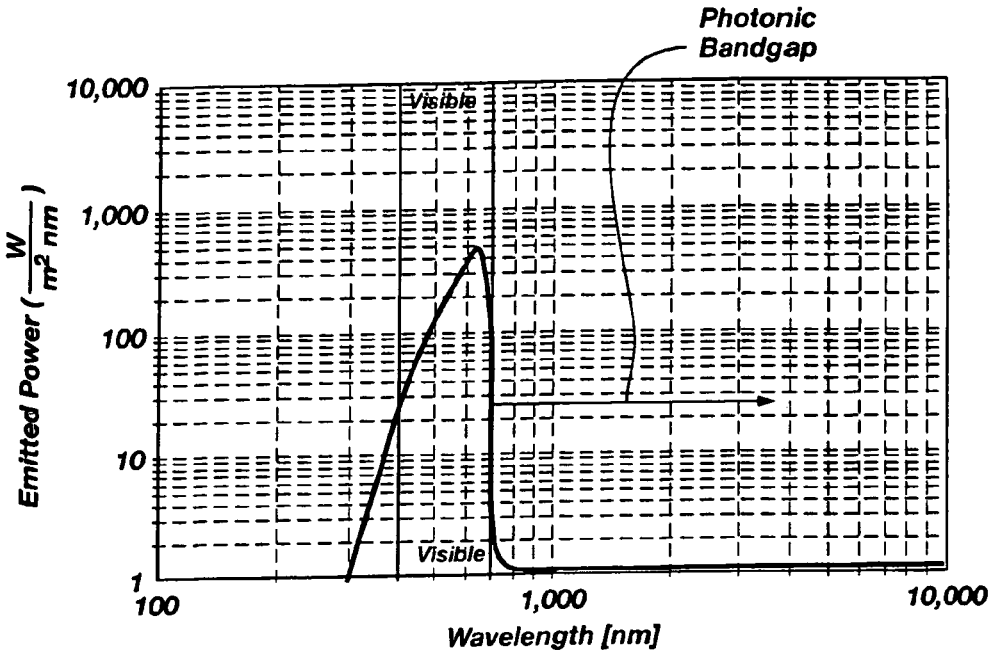
FIG. 9 is an exemplary graph of the approximate spectral radiant emittance of a radiation emitting structure according to the invention as a function of wavelength.

Electromagnetic radiation emitted by the active radiation emitter 111 at wavelengths within the photonic bandgap of the passive photonic crystal structure 114 (i.e., between about 700 nm and about 10000 nm) may be reflected internally thereby. Infrared radiation 118 is shown reflecting internally and visible radiation 119 is shown transmitting through the passive photonic crystal structure 114 in FIG. 3A. The reflected infrared radiation 118 may be absorbed by the active radiation emitter 111, thereby further heating the active radiation emitter 111 and contributing to emission of electromagnetic radiation within the visible region of the spectrum. An exemplary graph of the resulting approximate spectral emittance of the radiation emitting structure 110 as a whole is illustrated in FIG. 9.

The passive photonic crystal structure 114 may comprise a plurality of concentric tube-shaped regions (not shown), each tube-shaped region comprising passive fibers 115 having different diameters and different spacing therebetween. In such a configuration, each region may exhibit a photonic bandgap spanning a range of wavelengths different from the bandgaps of the other regions. By including a plurality of regions, the bandgaps of the plurality of regions may overlap, thereby broadening the effective bandgap of the passive photonic crystal structure 114 and improving the efficiency of the radiation emitting structure 110.

Figure 4:
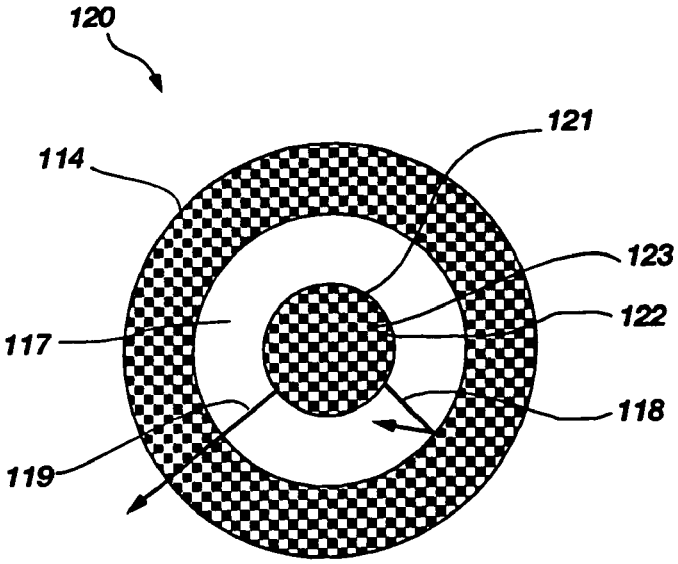
FIG. 4 is a cross-sectional view of an exemplary radiation emitting structure, that may be used in the incandescent lamp of FIG. 2, including an active photonic crystal emitter.

A cross-sectional schematic view of an exemplary radiation emitting structure 120 is shown in FIG. 4 that may be used in the exemplary incandescent lamp 100 of FIG. 2. The radiation emitting structure 120 may include an active photonic crystal emitter 121 and the passive photonic crystal structure 114 (described previously in relation to the radiation emitting structure 110) surrounding the active photonic crystal emitter 121. The radiation emitting structure 120 also may include the intermediate layer of material 117 (described previously in relation to the radiation emitting structure 110).

The active photonic crystal emitter 121 may include a two-dimensional photonic crystal structure formed by providing elongated active fibers 122 extending through a matrix 123. The active fibers 122 may be formed from, for example, tungsten, tungsten alloy, carbon, silicon carbide, or any other material that may be formed into a fiber and that will emit radiation in the visible region when heated. The active fibers 122 may have a diameter between about 0.05 microns and about 8 microns. The matrix 123 may comprise air, silica, silicon nitride, or any other material having a dielectric constant different from the dielectric constant of the material of the active fibers 122. The active fibers 122 are dispersed periodically throughout the matrix 123 and separated from one another by an average distance of between about 0.05 and about 8 microns. Alternatively, the matrix 123 could comprise, for example, tungsten or tungsten alloy and the active fibers could comprise, for example, elongated columns of air, silica, or silicon nitride.

Figure 10:
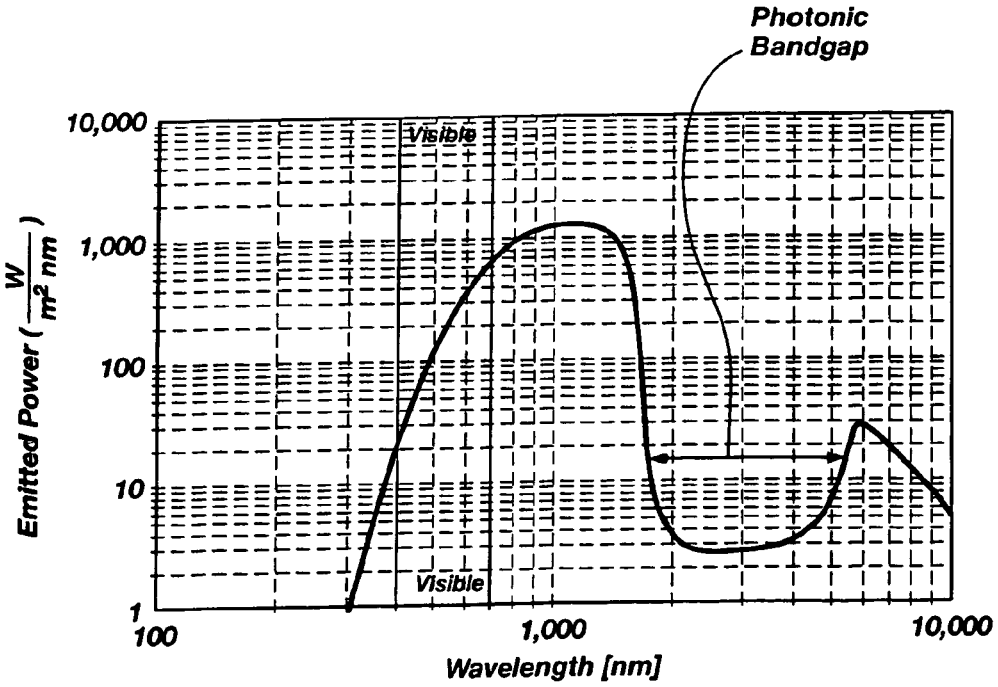
FIG. 10 is an exemplary graph of the approximate spectral radiant emittance of an active photonic crystal emitter as a function of wavelength.

When heated, photonic crystal structures may not emit radiation at wavelengths within the photonic bandgap thereof. Radiation at these wavelengths would be emitted if the photonic crystal were a black body. For example, an active photonic crystal emitter may exhibit a spectral radiant emittance as shown in the graph of FIG. 10. Therefore, photonic crystals having a bandgap spanning wavelengths in the infrared region may be used as an improved incandescent emitter, relative to conventional incandescent filaments. Active photonic crystal emitters are more efficient than conventional filament emitters (e.g., the emitter 110), which approximate a black body, because less radiation is emitted in the infrared region of the spectrum, as can be seen by comparing the graphs of FIGS. 1 and 10.

However, even an active photonic crystal emitter may emit some radiation at wavelengths outside the visible region of the spectrum, such as in the infrared region. For example, the photonic bandgap of the active photonic crystal emitter may not span the entire range of the infrared region of the spectrum. In addition, the outermost layers of an active photonic crystal emitter may emit radiation approximating that emitted by a black body since no dielectric periodicity is experienced when the emitted radiation does not pass through at least two layers of the crystal. Therefore, radiation may be emitted by the outermost layers of an active photonic crystal emitter at wavelengths within the photonic bandgap, which is exhibited by the active photonic crystal emitter as a whole. The passive photonic crystal structure 114 may reflect at least some of this radiation at wavelengths outside the visible region of the spectrum emitted by the active photonic crystal emitter 121 of the radiation emitting structure 120.

The combination of the active photonic crystal emitter 121 with the surrounding passive photonic crystal structure 114, which operates as an infrared reflector, provides improved efficiency over both an active photonic crystal emitter alone and a conventional emitter surrounded by the passive photonic crystal structure 114. Infrared radiation 118 is shown reflecting internally and visible radiation 119 is shown transmitting through the passive photonic crystal structure 114 in FIG. 4. The reflected infrared radiation 118 may be absorbed by the active photonic crystal emitter 121, thereby further heating the active photonic crystal emitter 121 and contributing to emission of electromagnetic radiation in the visible region of the spectrum.

Figure 5:
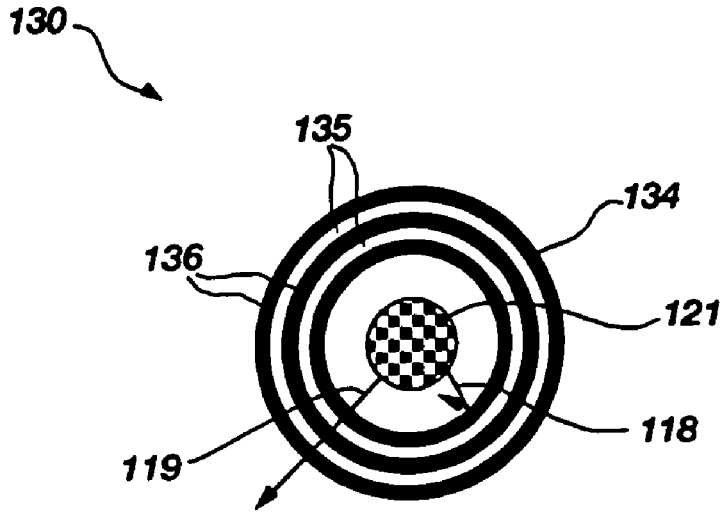
FIG. 5 is a cross-sectional view of an exemplary radiation emitting structure, that may be used in the incandescent lamp of FIG. 2, including an active photonic crystal emitter.

A cross-sectional schematic view of an exemplary radiation emitting structure 130 that may be used in the exemplary incandescent lamp 100 is shown in FIG. 5. The radiation emitting structure 130 may include the active photonic crystal emitter 121 (described previously in relation to the radiation emitting structure 120 of FIG. 4), and a passive photonic crystal structure 134 circumferentially surrounding the active photonic crystal emitter 121. The radiation emitting structure 130 also may include the intermediate layer of material 117 (described previously in relation to the radiation emitting structure 110 of FIG. 3A).

The passive photonic crystal structure 134 may include a cylindrical Bragg mirror (i.e., distributed Bragg reflector) having alternating first material layers 135 and second material layers 136. The dielectric constant of the first material layers 135 should be different from the dielectric constant of the second material layers 136. The first material layers 135 may be formed from, for example, silicon carbide, carbon, titania, silver, gold, tungsten, copper, any other metal or metal alloy, or any other suitable material. The second material layers 136 may be formed from, for example, silica, silicon nitride, or any other suitable material having a dielectric constant different from the dielectric constant of the first material layers 135. The first material layers 135 and the second material layers 136 may have a thickness between about 0.05 microns and about 8 microns.

The passive photonic crystal structure 134 is a one-dimensional photonic crystal structure that may operate as an infrared reflector in the same manner as the passive photonic crystal structure 114 of FIGS. 3 and 4, and may internally reflect radiation within the radiation emitting structure 130. Infrared radiation 118 is shown reflecting internally and visible radiation 119 is shown transmitting through the passive photonic crystal structure 134 in FIG. 5. The reflected infrared radiation 118 may be absorbed by the active photonic crystal emitter 121, thereby further heating the active photonic crystal emitter 121 and contributing to emission of electromagnetic radiation in the visible region of the spectrum.

In addition, the passive photonic crystal structure 134 may comprise a plurality of concentric tube-shaped regions (not shown), the thickness of the first material layers 135 and second material layers 136 in each concentric tube-shaped region differing from the thickness of the layers in other regions. In such a configuration, each region may exhibit a photonic bandgap spanning a range of wavelengths different from the bandgaps of the other regions. By including a plurality of regions, the bandgaps of the plurality of regions may overlap, thereby broadening the effective bandgap of the passive photonic crystal structure 114 and improving the efficiency of the incandescent lamp 100.

The radiation emitting structures 110, 120, and 130 first may be formed as a filament bundle, including the emitter and surrounding passive photonic crystal structure, having cross-sectional dimensions greater than those required by the end product, but having the same dimensional proportions. Subsequently, the filament bundle may be drawn by known fiber or filament drawing techniques to decrease the overall dimensions of the structure to the required specifications. Such techniques are known in the art and discussed, for example, in U.S. Pat. No. 5,802,236 ("the '236 patent") and U.S. Pat. No. 6,522,820 ("the '820 patent"), the contents of which are incorporated by reference herein.

For example, as discussed in the '236 patent, a preform can be formed by bundling hollow silica capillary tubes around a center silica glass rod, being sure to physically arrange them in a scaled version of the ultimate desired pattern. One or more silica overcladding tubes are then placed around the entire bundle and melted around the bundle to produce the desired preform. The preform is then drawn using conventional techniques to generate an optical fiber. The process may be slightly modified to form the radiating emitting structures 110, 120, and 130. For example, to form the radiation emitting structure 110, a first hollow silica cylinder may be surrounded by smaller, hollow silica capillary tubes, which are arranged in a periodic array. This structure may be placed within a second, thin silica tube of larger diameter, which holds the capillary tubes in place. This structure then may be sintered to bond the silica structures together. The interior of what was previously the first hollow silica cylinder may be filled with tungsten material to form the final preform of proper dimensional proportions. The preform may then be drawn as disclosed in the '236 patent. Upon drawing, the tungsten material will become active radiation emitter 111, the first hollow silica cylinder will become intermediate layer of material 117, and the array of capillary tubes will become passive photonic crystal structure 114. The radiation emitting structures 120 and 130 may be formed in a similar manner.

The '820 patent discloses an alternative method that may be used to form the radiating emitting structures 110, 120, and 130. As disclosed therein, a first silica preform may be produced and sliced into thin wafers. Features may be formed in and through each of thin wafers using known lithographic techniques. The thin wafers then may be aligned and bonded together to form a second preform, which can then be drawn into an elongated filament by known techniques to produce the radiation emitting structure. For example, to form the radiation emitting structure 120, the thinly-sliced silica wafers may be etched to form holes or voids at the center of each silica wafer, which can later be filled with tungsten material to form what will become the active photonic crystal emitter 121 after drawing. Holes or voids also may be formed near the outer peripheral edge of each silica wafer to form what will become the passive photonic crystal structure 114 after drawing. The radiation emitting structures 110 and 130 may be formed in a similar manner.

Figure 6:
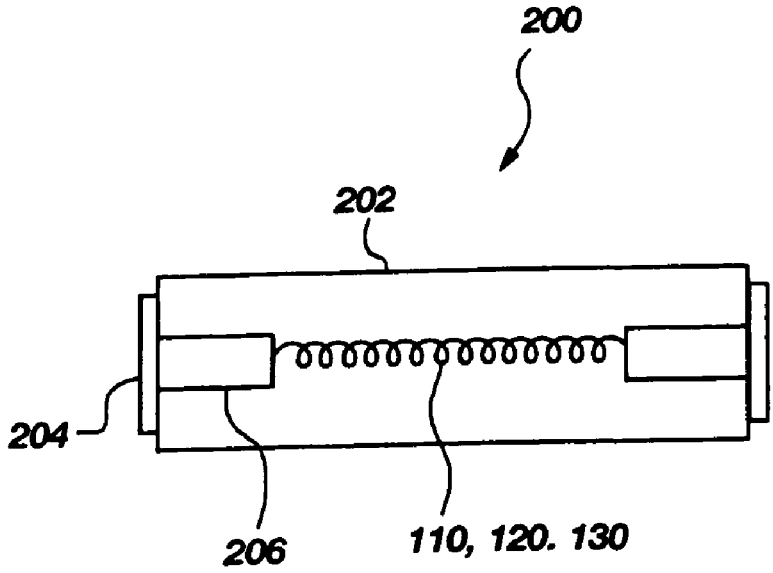
FIG. 6 is a perspective view of an incandescent lamp including an exemplary radiation emitting structure.

As shown in FIG. 6, another exemplary incandescent lamp 200 includes a glass tube 202, electrical terminals 204 at the ends of the glass tube 202 for connection to a power supply, and electrical contacts 206 electrically communicating with the electrical terminals 204. The lamp 200 may include any one of the radiation emitting structures 110, 120, and 130. The radiation emitting structures 110, 120, and 130 may be provided as an elongated filament, which may be coiled and double coiled in the same manner as conventional incandescent filaments. The radiation emitting structure 110, 120, 130 is shown in a coiled configuration in the lamp 200 of FIG. 6. A coiled configuration may be used to provide a radiation emitting structure according to the invention having an increased efficiency over uncoiled structures. In addition, the interior of the glass tube 202 may be filled with a halogen gas as known in the industry to extend the life of the radiation emitting structure and improve the operating characteristics thereof.

Figure 7A:
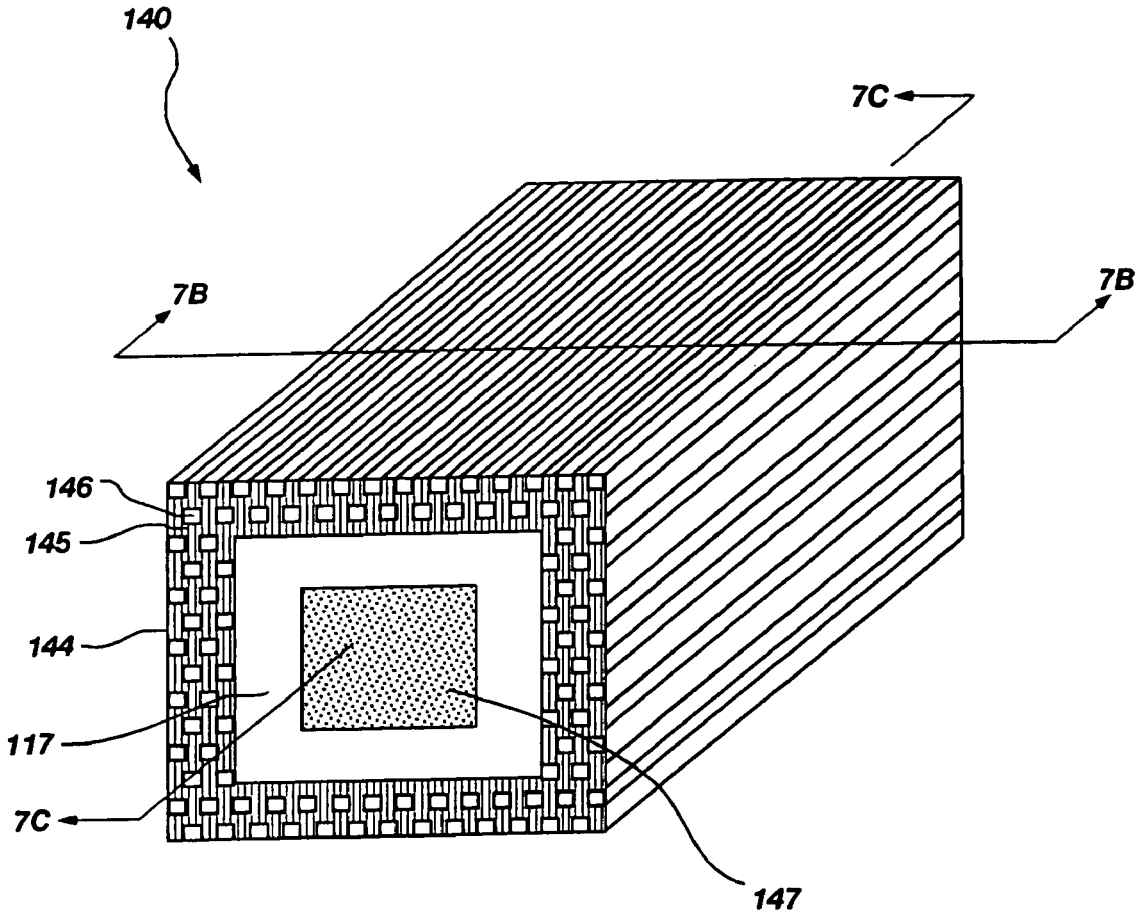
FIG. 7A is a perspective view of an exemplary radiation emitting structure.
Figure 7B:
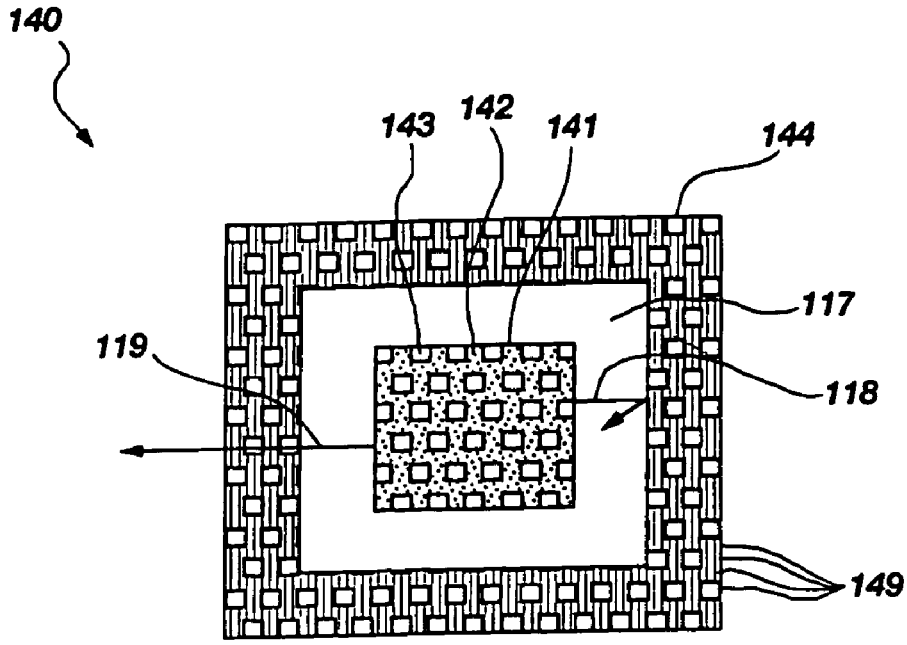
FIG. 7B is a cross-sectional view of the exemplary radiation emitting structure of FIG. 7A taken along section line 7B-7B therein.
Figure 7C:
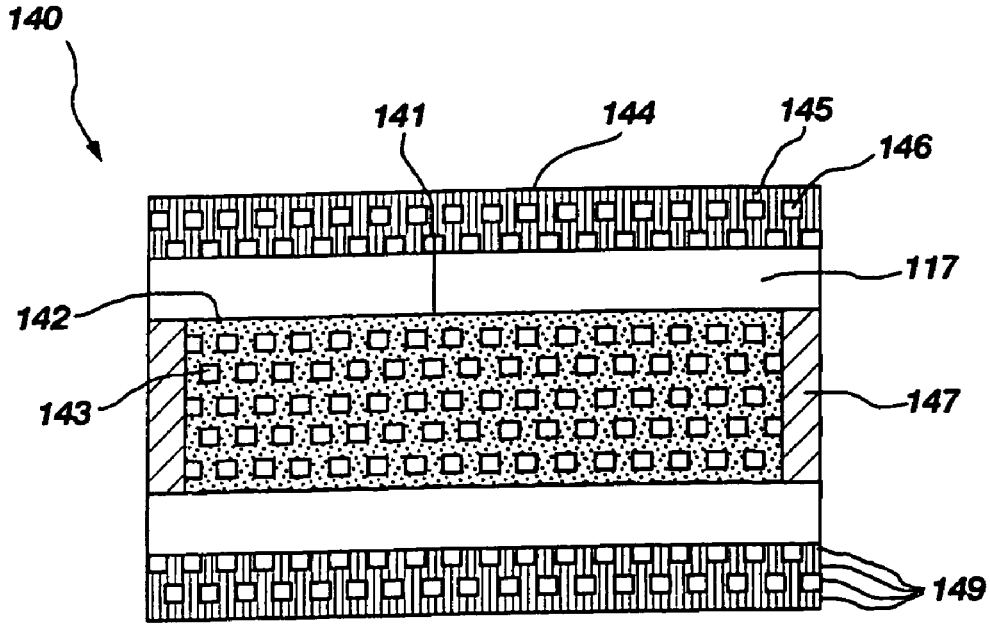
FIG. 7C is a cross-sectional view of the exemplary radiation emitting structure of FIG. 7A taken along section line 7C-7C therein.

An exemplary radiation emitting structure 140, shown in FIGS. 7A-7C, may be used in either of the exemplary incandescent lamps 100 and 200. The radiation emitting structure 140 includes an active photonic crystal emitter 141 and a passive photonic crystal structure 144 surrounding the active photonic crystal emitter 141. The radiation emitting structure 140 may also include the intermediate layer of material 117 (described previously in relation to the radiation emitting structure 110 of FIG. 3A).

The active photonic crystal emitter 141 (FIGS. 7B and 7C) may have a three-dimensional lattice structure exhibiting dielectric periodicity. The active photonic crystal emitter 141 may include active rods 142 periodically arranged in alternating layers 149 within a matrix 143. In each layer, the active rods 142 are arranged parallel to one another and separated from one another by an average distance of between about 0.05 microns and about 8 microns. Each active rod 142 may have a thickness between about 0.05 microns and about 8 microns, and may have a width of between about 0.05 microns and about 8 microns. The length of the active rods 142 is not particularly important. The active rods 142 of each layer are oriented perpendicular to the active rods 142 of the layers 149 directly above and directly below. The active rods 142 may be formed from, for example, tungsten, tungsten alloy, carbon, silicon carbide, or any other suitable material that will emitting visible radiation when heated. This configuration is commonly referred to as the "Lincoln log" type photonic crystal structure. The matrix 143 of the active photonic crystal emitter 141 may be, for example, air, silica, silicon nitride, silicon carbide, carbon, alumina, or titania.

The radiation emitting structure 140 may include a passive photonic crystal structure 144 surrounding the active photonic crystal emitter 141. The passive photonic crystal structure 144 also may be formed having the same three-dimensional lattice structure as the active photonic crystal emitter 141. The passive photonic crystal structure 144 may include passive rods 145 periodically arranged in alternating layers 149 within a matrix 146. In each layer 149, the passive rods 145 may be arranged parallel to one another, and may be separated from one another by an average distance of between about 0.05 microns and about 8 microns. Each passive rod 145 may be between about 0.05 microns and about 8 microns thick, and between about 0.05 microns and about 8 microns wide. The length of the passive rods 145 is not particularly important. The active rods 142 may be formed from, for example, silver, gold, silica, silicon nitride, silicon carbide, carbon, titania, or any other suitable material. The matrix 146 of the passive photonic crystal structure 144 may be air, silica, silicon nitride, silicon carbide, carbon, or titania. However, the material of the passive rods 145 should have a dielectric constant different from the dielectric constant of the material of the matrix 146. Alternatively, the radiation emitting structure 140 could include the passive photonic crystal structure 114 of FIGS. 3 and 4 instead of the passive photonic crystal structure 144.

Electrical contacts 147 (FIGS. 7A and 7C) that are electrically continuous with the active photonic crystal emitter 141, may be provided on the ends of the radiation emitting structure 140 for communicating electrically with the electrical contacts 106 of the incandescent lamp 100 (FIG. 2), or with the electrical contacts 206 of the incandescent lamp 200 (FIG. 6). The passive photonic crystal structure 144 may be electrically insulated from the electrical contacts 147 by the intermediate layer of material 117 to prevent current flow through the passive photonic crystal structure 144 during operation.

The passive photonic crystal structure 144 is a three-dimensional photonic crystal structure that may operate as an infrared reflector in the same manner as the passive photonic crystal structure 114 of FIGS. 3 and 4 to internally reflect radiation within the radiation emitting structure 140. Infrared radiation 118 is shown reflecting internally and visible radiation 119 is shown transmitting through the passive photonic crystal structure 144 in FIG. 7B. The reflected infrared radiation 118 may be absorbed by the active photonic crystal emitter 141, thereby further heating the active photonic crystal emitter 141 and contributing to emission of electromagnetic radiation in the visible region of the spectrum.

Figure 8A:
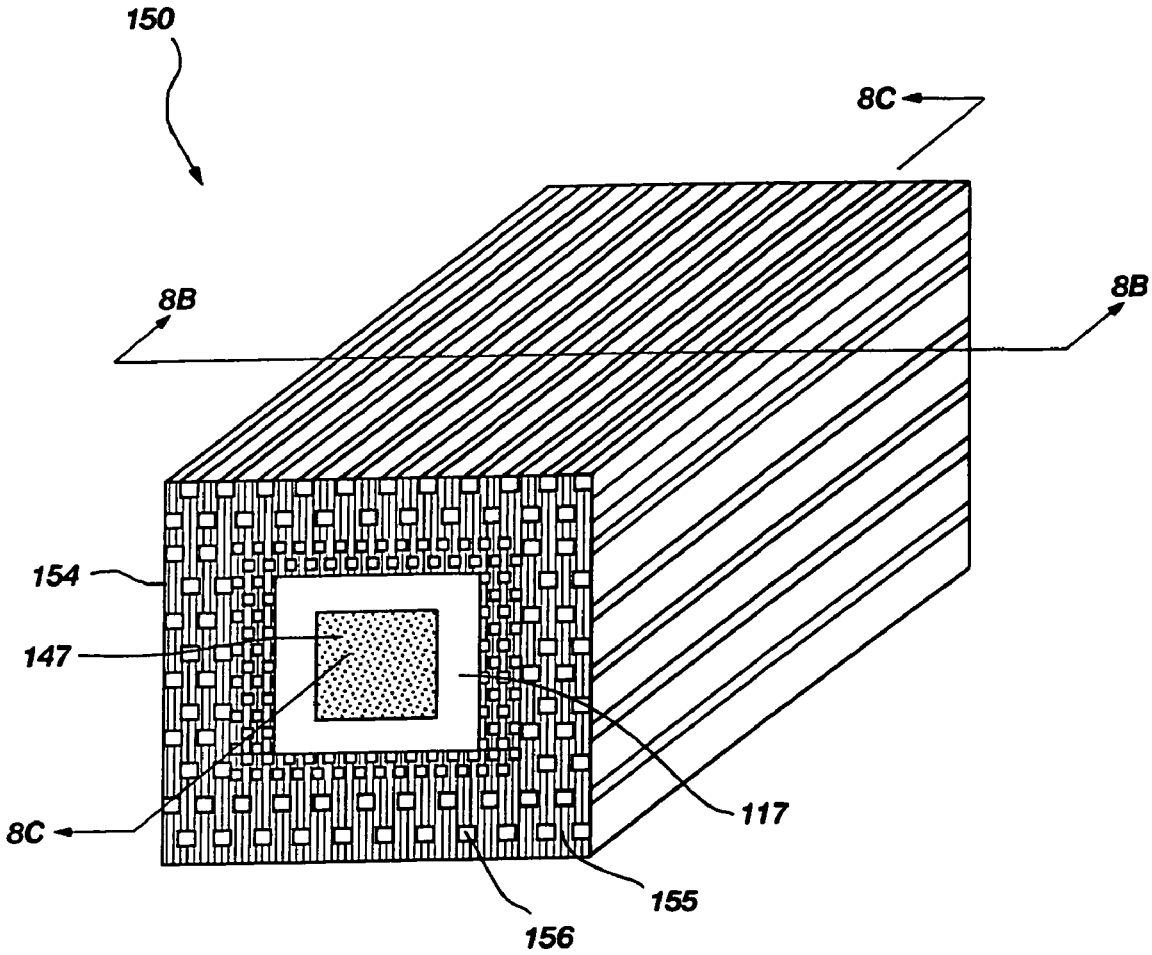
FIG. 8A is a perspective view of an exemplary radiation emitting structure.
Figure 8B:
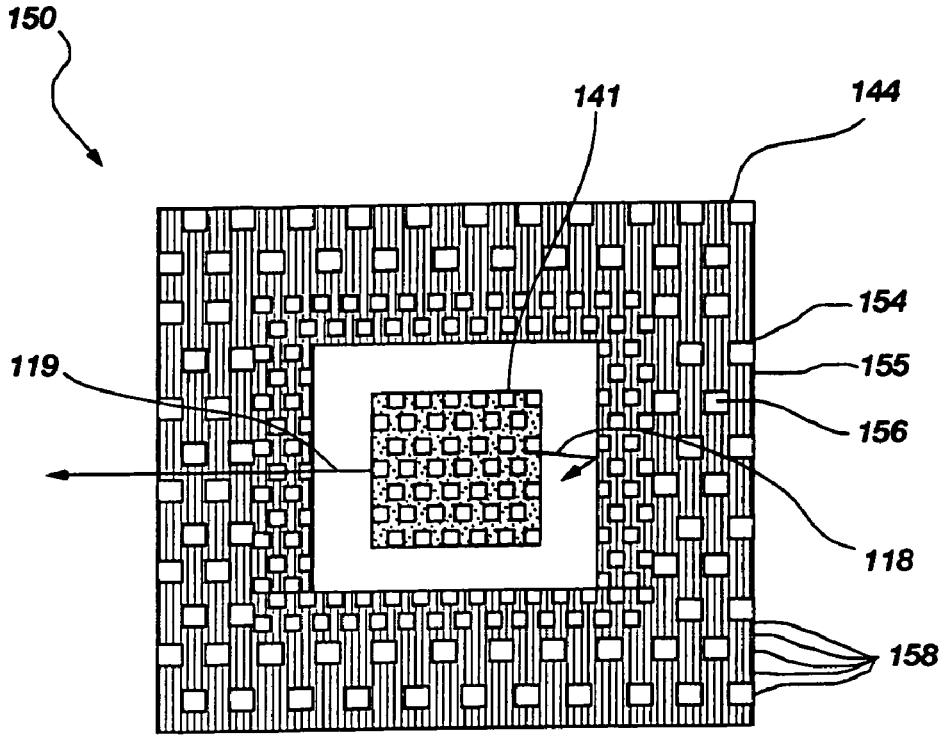
FIG. 8B is a cross-sectional view of the exemplary radiation emitting structure of FIG. 8A taken along section line 8B-8B therein.
Figure 8C:
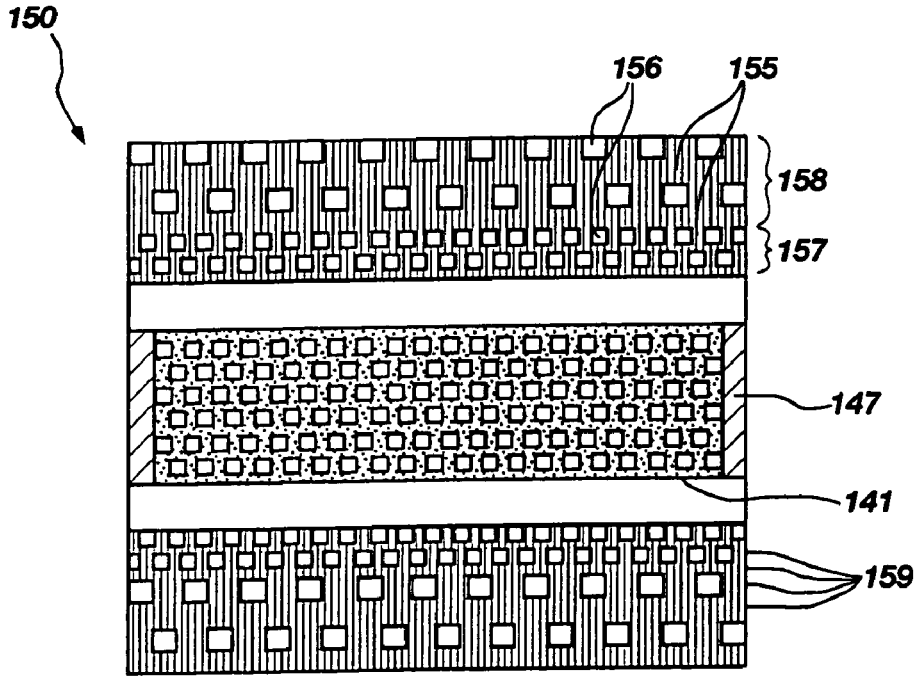
FIG. 8C is a cross-sectional view of the exemplary radiation emitting structure of FIG. 8A taken along section line 8C-8C therein.

An exemplary radiation emitting structure 150 is shown in FIGS. 8A-8C that may be used in either of the exemplary incandescent lamps 100 and 200. The radiation emitting structure 150 may include the active photonic crystal emitter 141 (FIGS. 8B and 8C) (described in relation to the radiation emitting structure 140 of FIGS. 7A-7C) and a passive photonic crystal structure 154 surrounding the active photonic crystal emitter 141. The radiation emitting structure 150 also may include the intermediate layer of material 117 (described previously in relation to the radiation emitting structure 110 of FIG. 3A).

The passive photonic crystal structure 154 may have the same three-dimensional lattice structure as the passive photonic crystal structure 144 (described previously in relation to the radiation emitting structure 140 of FIGS. 7A-7C), including passive rods 155 periodically arranged in alternating layers 159 within a matrix 156. However, the passive photonic crystal structure 154 may include a first region 157 and a second region 158 (FIG. 8C). The passive rods 155 of the first region 157 may be smaller than the passive rods 155 of the second region 158. In addition, the distance between adjacent passive rods 155 in the first region 157 may be less than the distance between adjacent passive rods 155 in the second region 158. These differences may result in the first region exhibiting a first photonic bandgap spanning a first range of wavelengths and the second region 158 exhibiting a second photonic bandgap spanning a second, different range of wavelengths (the first range of wavelengths may overlap the second range of wavelengths). Thus, the effective bandgap of the entire passive photonic crystal structure 154 may be broadened in relation to a structure having only one region and corresponding bandgap.

Electrical contacts 147 that are electrically continuous with the active photonic crystal emitter 141 may be provided on the ends of the radiation emitting structure 150 for connection thereof to the electrical contacts 106 of the incandescent lamp 100 (FIG. 2), or to the electrical contacts 206 of the incandescent lamp 200 (FIG. 6). The passive photonic crystal structure 154 may be electrically insulated from the electrical contacts 147 by the intermediate layer of material 117 to prevent current flow through the passive photonic crystal structure 154 during operation.

The passive photonic crystal structure 154 is a three-dimensional photonic crystal structure that may operate as an infrared reflector in the same manner as the passive photonic crystal structure 114 of FIGS. 3 and 4, and may reflect radiation internally within the radiation emitting structure 150. Infrared radiation 118 is shown reflecting internally and visible radiation 119 is shown transmitting through the passive photonic crystal structure 154 in FIG. 8B. The reflected infrared radiation 118 may be absorbed by the active photonic crystal emitter 141, thereby further heating the active photonic crystal emitter 141 and contributing to emission of electromagnetic radiation in the visible region of the spectrum.

The radiation emitting structure 140 and the radiation emitting structure 150 may be formed by conventional microelectronic fabrication techniques on a support substrate such as, for example, a silicon wafer, partial wafer, or a glass substrate. Examples of techniques for depositing material layers include, but are not limited to, molecular beam epitaxy (MBE), atomic layer deposition (ALD), chemical vapor deposition (CVD), physical vapor deposition (PVD), sputter deposition and other known microelectronic layer deposition techniques. Photolithography may also be used to form structures in individual layers. In addition, holographic lithography may be used to construct the radiation emitting structures. Examples of techniques that can be used for selectively removing portions of the layers include, but are not limited to, wet etching, dry etching, plasma etching, and other known microelectronic etching techniques. Such techniques are known in the art and discussed, for example, in U.S. Pat. No. 6,611,085 ("the '085 patent"), the contents of which are incorporated by reference herein.

The '085 patent discloses a method for forming a photonically engineered incandescent emitter. The emitter is formed by repetitive deposition and etching of multiple dielectric films in a layer-by-layer method. To form the radiation emitting structures 140 and 150, the method disclosed in the '085 patent may be modified to include the step of depositing layers of silica, or regions of silica in layers having a photonic crystal structure when necessary to form the intermediate layers of material 117. As a final step, the electrical contacts 147 may be formed on the ends of the active photonic crystal emitter 144.

In alternative embodiments of the invention (not illustrated), an emitter such as active photonic emitter 141 may be enclosed by a material having a spherical-shape, the material forming a layer similar to intermediate layer of material 117. A filament can then be wound about the exterior surface of the spherical-shaped material to produce an outer, two-dimensional passive photonic crystal structure that may function as a filter for electromagnetic radiation outside the visible region of the electromagnetic spectrum in a manner similar to passive photonic crystal structure 114. The filament can be formed from dielectric materials such as carbon, silicon carbide, silica, alumina, titania, or from a metal such as, for example, silver, gold, tungsten, copper, any other metal or metal alloy.

Lamps including radiation emitting structures embodying the invention disclosed herein may provide increased efficiency over known incandescent lamps and filaments.

Although the foregoing description contains many specifics, these are not to be construed as limiting the scope of the present invention, but merely as providing certain exemplary embodiments. Similarly, other embodiments of the invention may be devised which do not depart from the spirit or scope of the present invention. The scope of the invention is, therefore, indicated and limited only by the appended claims and their legal equivalents, rather than by the foregoing description. All additions, deletions, and modifications to the invention, as disclosed herein, which fall within the meaning and scope of the claims are encompassed by the present invention.

What is claimed is:

1. A radiation emitting structure comprising:

an active radiation emitter; and a passive photonic crystal structure transparent to wavelengths of electromagnetic radiation within the visible region of the electromagnetic spectrum surrounding the emitter; wherein the passive photonic crystal structure comprises a plurality of regions, each region of the plurality of regions exhibiting a photonic bandgap over a range of electromagnetic wavelengths, each range of electromagnetic wavelengths including wavelengths outside the visible region of the electromagnetic spectrum emitted by the emitter when it is heated, the range of the photonic bandgap of each region of the plurality of regions differing from the range of another region.

2. The radiation emitting structure of claim 1, wherein the range of the photonic bandgap of at least one region of the plurality of regions includes wavelengths within the infrared region of the electromagnetic spectrum.

3. The radiation emitting structure of claim 2, wherein the range of photonic bandgap of the at least one region of the plurality of regions includes wavelengths between about 780 nm and about 3000 nm.

4. The radiation emitting structure of claim 1, wherein the passive photonic crystal structure comprises a dielectric material.

5. The radiation emitting structure of claim 4, wherein the dielectric material comprises one of $SiO_2$ and SiN.

6. The radiation emitting structure of claim 1, wherein the passive photonic crystal structure comprises a metal.

7. The radiation emitting structure of claim 6, wherein the metal comprises one of Ag, Au, and W.

8. The radiation emitting structure of claim 1, wherein the passive photonic crystal structure comprises a one-dimensional photonic crystal.

9. The radiation emitting structure of claim 8, wherein the passive photonic crystal structure comprises a Bragg mirror.

10. The radiation emitting structure of claim 9, wherein the Bragg mirror is cylindrical.

11. The radiation emitting structure of claim 10, wherein the Bragg mirror comprises alternating layers of a first material having a first dielectric constant and a second material having a second dielectric constant.

12. The radiation emitting structure of claim 11, wherein the Bragg mirror comprises alternating layers having a thickness of between about 0.05 microns and about 8 microns.

13. The radiation emitting structure of claim 1, wherein the passive photonic crystal structure comprises a two-dimensional photonic crystal.

14. The radiation emitting structure of claim 13, wherein the passive photonic crystal structure comprises a plurality of passive filaments dispersed periodically and circumferentially about the emitter.

15. The radiation emitting structure of claim 14, wherein each passive filament of the plurality of passive filaments comprises one of carbon, silicon carbide, silica, alumina, titania, silver, gold, tungsten, and copper.

16. The radiation emitting structure of claim 15, wherein each passive filament of the plurality of passive filaments has a diameter between about 0.05 microns and about 8 microns.

17. The radiation emitting structure of claim 16, wherein each passive filament of the plurality of passive filaments is separated from other passive filaments by an average distance of between about 0.05 microns and about 8 microns.

18. The radiation emitting structure of claim 1, wherein the passive photonic crystal structure comprises three-dimensional photonic crystal.

19. The radiation emitting structure of claim 18, wherein the lattice structure comprises:

a plurality of layers, each layer comprising a plurality of parallel rods, each rod of the plurality of rods oriented substantially perpendicular to the plurality of rods of the layer directly above and directly below; and a matrix material disposed between the plurality of rods.

20. The radiation emitting structure of claim 19, wherein the matrix comprises air.

21. The radiation emitting structure of claim 19, wherein each rod of the plurality of rods has a thickness between about 0.05 microns and about 8 microns, and a width of between about 0.05 microns and about 8 microns.

22. The radiation emitting structure of claim 19, wherein the plurality of rods of each layer are separated by an average distance of between about 0.05 microns and about 8 microns.

23. The radiation emitting structure of claim 1, wherein the emitter comprises an active filament.

24. The radiation emitting structure of claim 23, wherein the active filament comprises tungsten or tungsten alloy.

25. The radiation emitting structure of claim 24, wherein the active filament and the passive photonic crystal structure are coiled.

26. The radiation emitting structure of claim 1, wherein the emitter comprises an active photonic crystal emitter.

27. The radiation emitting structure of claim 26, wherein the active photonic crystal emitter comprises a plurality of active filaments.

28. The radiation emitting structure of claim 27, wherein each active filament of the plurality of active filaments comprises tungsten or tungsten alloy.

29. The radiation emitting structure of claim 27, wherein each active filament of the plurality of active filaments has a diameter between about 0.05 microns and about 8 microns.

30. The radiation emitting structure of claim 27, wherein each active filament of the plurality of active filaments is separated by an average distance between about 0.05 microns and about 8 microns.

31. The radiation emitting structure of claim 26, wherein the active photonic crystal emitter comprises a lattice structure exhibiting dielectric periodicity.

32. The radiation emitting structure of claim 27, wherein the lattice structure comprises:

a plurality of layers, each layer comprising a plurality of parallel rods, each rod of the plurality of rods oriented substantially perpendicular to the plurality of rods of the layer directly above and directly below; and a matrix material disposed between the plurality of rods.

33. The radiation emitting structure of claim 32, wherein the matrix material comprises air.

34. The radiation emitting structure of claim 32, wherein each rod of the plurality of rods has a thickness between about 0.05 microns and about 8 microns, and a width of between about 0.05 microns and about 8 microns.

35. The radiation emitting structure of claim 32, wherein the plurality of rods of each layer are separated by an average distance of between about 0.05 microns and about 8 microns.

36. The radiation emitting structure of claim 1, further comprising an intermediate layer of material transparent to electromagnetic radiation within the visible region of the electromagnetic spectrum between the passive photonic crystal and the emitter.

37. The radiation emitting structure of claim 36, wherein the intermediate layer of material is electrically insulating.

38. The radiation emitting structure of claim 37, further comprising two electrical contacts attached to the emitter for connection to a power supply, and wherein the passive photonic crystal structure is electrically isolated from the contacts by the insulating intermediate layer of material.

39. An incandescent lamp comprising a radiation emitting structure, the radiation emitting structure comprising:

an emitter; and a photonic crystal structure comprising a plurality of regions, at least one region of the plurality of regions exhibiting a first photonic bandgap that differs from a second photonic bandgap exhibited by at least one other region of the plurality of regions, the photonic crystal structure positioned relative to the emitter to prevent at least one wavelength of electromagnetic radiation emitted by the emitter upon heating from passing through the photonic crystal structure.

40. A radiation emitting structure comprising:

a radiation emitter; and a photonic crystal structure at least partially surrounding the radiation emitter, the photonic crystal structure comprising a plurality of regions, at least one region of the plurality of regions exhibiting a first photonic bandgap that differs from a second photonic bandgap exhibited by at least one other region of the plurality of regions.

41. The radiation emitting structure of claim 40, wherein the photonic crystal structure is transparent to at least one wavelength of electromagnetic radiation emitted by the radiation emitter, and at least one of the first photonic bandgap and the second photonic bandgap comprising at least one other wavelength of electromagnetic radiation emitted by the emitter.

* * * * *

UNITED STATES PATENT AND TRADEMARK OFFICE

CERTIFICATE OF CORRECTION

PATENT NO. : 7,368,870 B2
APPLICATION NO. : 10/959704
DATED : May 6, 2008
INVENTOR(S) : Shih-Yuan Wang It is certified that error appears in the above-identified patent and that said Letters Patent is hereby corrected as shown below:

In column 12, line 6, in Claim 3, after “range of” insert -- the --.

In column 12, line 53, in Claim 18, after “comprises” insert -- a --.

Signed and Sealed this

Thirtieth Day of September, 2008

JON W. DUDAS
*Director of the United States Patent and Trademark Office*